US007532093B1

(12) United States Patent
Pulskamp et al.

(10) Patent No.: US 7,532,093 B1
(45) Date of Patent: May 12, 2009

(54) RF MEMS SERIES SWITCH USING PIEZOELECTRIC ACTUATION AND METHOD OF FABRICATION

(75) Inventors: Jeffrey S. Pulskamp, McLean, VA (US); Ronald G. Polcawich, Derwood, MD (US); Daniel Judy, Odenton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 375 days.

(21) Appl. No.: 11/518,746

(22) Filed: Sep. 7, 2006

Related U.S. Application Data

(63) Continuation-in-part of application No. 11/347,291, filed on Feb. 6, 2006.

(51) Int. Cl.
*H01P 1/10* (2006.01)
*H01H 57/00* (2006.01)

(52) U.S. Cl. ..... 333/262; 333/105

(58) Field of Classification Search ..... 333/101, 333/105, 262; 200/181; 335/78
See application file for complete search history.

(56) References Cited

U.S. PATENT DOCUMENTS

| | | | | |
|---|---|---|---|---|
| 5,578,976 | A | 11/1996 | Yao | |
| 5,914,507 | A | 6/1999 | Polla et al. | |
| 6,069,540 | A | 5/2000 | Berenz et al. | |
| 6,100,477 | A | 8/2000 | Randall et al. | |
| 6,360,036 | B1 | 3/2002 | Couillard | |
| 6,515,404 | B1 | 2/2003 | Wong | |
| 6,639,488 | B2 | 10/2003 | Deligianni et al. | |
| 6,762,378 | B1 | 7/2004 | Wong | |
| 6,768,068 | B1 | 7/2004 | Wong et al. | |
| 6,797,631 | B2 | 9/2004 | Kim et al. | |
| 7,274,278 | B2 * | 9/2007 | Weller et al. | 333/262 |
| 7,321,275 | B2 * | 1/2008 | Chou et al. | 333/105 |
| 2004/0091203 | A1 * | 5/2004 | Huber et al. | 385/18 |

OTHER PUBLICATIONS

Hoffmann, M. et al., "Fabrication and Characterization of PZT Thin Film Actuator for a Micro Electromechanical Switch Application," Mat. Res. Soc. Symp. Proc. vol. 688, 2002 Materials Research Society, pp. C5.9.1-C5.9.8.

(Continued)

*Primary Examiner*—Dean O Takaoka
(74) *Attorney, Agent, or Firm*—Edward L. Stolarun

(57) ABSTRACT

A microelectromechanical system (MEMS) switch comprising a radio frequency (RF) transmission line; a structurally discontinuous RF conductor adjacent to the RF transmission line; a pair of cantilevered piezoelectric actuators flanking the RF conductor; a contact pad connected to the pair of cantilevered piezoelectric actuators; a pair of cantilevered structures connected to the RF conductor; a plurality of air bridges connected to the pair of cantilevered piezoelectric actuators; and a plurality of contact dimples on the contact pad. Preferably, the RF transmission line comprises a pair of co-planar waveguide ground planes flanking the RF conductor; and a plurality of ground straps connected to the pair of co-planar waveguide ground planes, wherein the RF transmission line is operable to provide a path along which RF signals propagate.

24 Claims, 19 Drawing Sheets

OTHER PUBLICATIONS

Gross, S. et al. "RF MEMS Piezoelectric Switch," IEEE Device Research Conference, Jun. 23-25, 2003, pp. 99-100.

Gross, S. et al., "Lead-Zirconate-Titanate-Based Piezoelectric Micromachined Switch," Applied Physics Letters, vol. 83, No. 1, Jul. 7, 2003, pp. 174-176.

Fox, C. et al., "Development of Micromachined RF Switches with Piezofilm Actuation," Smart Structures and Materials 2002, Proceedings of SPIE, vol. 4700, 2002, pp. 40-49.

Lee, H. et al., "Silicon Bulk Micromachined RF MEMS Switches with 3.5 Volts Operation by Using Piezoelectric Actuator," IEEE MTT-S Digest, WE1B-4, 2004, pp. 585-588.

Lee, H. et al., "Piezoelectrically Actuated RF MEMS DC Contact Switches With Low Voltage Operation," IEEE Microwave and Wireless Components Letters, vol. 15, No. 4, pp. 202-204, Apr. 2005.

Lee, H. et al., "Design, fabrication and RF performances of two different types of piezoelectrically actuated Ohmic MEMS switches," Journal of Micromechanics and Microengineering, 15 (2005) 2098-2104.

* cited by examiner

RF MEMS SERIES SWITCH USING PIEZOELECTRIC ACTUATION AND METHOD OF FABRICATION

CROSS-REFERENCE TO RELATED APPLICATIONS

This application is a continuation-in-part of U.S. patent application Ser. No. 11/347,291 filed Feb. 6, 2006, the complete disclosure of which, in its entirety, is herein incorporated by reference.

GOVERNMENT INTEREST

The embodiments described herein may be manufactured, used, and/or licensed by or for the United States Government without the payment of royalties thereon.

BACKGROUND

1. Technical Field

The embodiments herein generally relate to microelectronic systems, and more particularly, to radio frequency (RF) microelectromechanical systems (MEMS) and piezoelectric MEMS actuation technology and microelectronics.

2. Description of the Related Art

MEMS devices are micro-dimensioned machines manufactured by typical integrated circuit (IC) fabrication techniques. The relatively small size of MEMS devices allows for the production of high speed, low power, and high reliability mechanisms. The fabrication techniques also allow for low cost mass production. MEMS devices typically include both electrical and mechanical components, but may also contain optical, chemical, and biomedical elements.

There are a number of actuation and sensing technologies used in MEMS technology; the most common are electrostatic, electrothermal, magnetic, piezoelectric, piezoresistive, and shape memory alloy technologies. Of these, electrostatic MEMS are generally the most common due to its simplicity of fabrication and inherent electromechanical capabilities. However, piezoelectric MEMS tend to out-perform electrostatic MEMS actuators in out-of-plane (vertical) displacements in terms of attainable range, power consumption, and voltage level. Parallel plate electrostatic actuators which are typical electrostatic out-of-plane actuators, generally attain vertical displacements on the order of a few microns for several tens of volts while consuming microwatts of power.

The MEMS industry has described the possibility of using piezoelectric thin films for use as microrelays or as RF MEMS switch actuators. One such microrelay device utilizes a sol-gel $PZ_{0.52}T_{0.48}$ (PZT) thin film actuator to close a direct current (DC) contact. In other conventional designs, a $d_{33}$ mode of operation as opposed to a $d_{31}$ mode of actuation is used.

Other conventional approaches utilize RF switches using PZT thin film actuators. Here, similar to the microrelay designs, the focus is on a cantilever structure. Moreover, some approaches use a cantilever that is perpendicular to the wave propagation direction along the RF conductor of the co-planar waveguide (CPW). Because of the relatively high dielectric constant of the PZT actuator, the RF fields can easily couple to the actuator forming a resonant structure. When the perpendicular actuator is exactly one quarter wavelength, the open circuit of the actuator will appear as a virtual ground at the center of the CPW structure causing the device to isolate the input from the output even when the switch is closed for a series switch or open for a shunt switch. If the actuator is arranged to be parallel to the CPW axis, the added capacitance of the actuator can be absorbed in the CPW itself, and no standing wave is generated as is the case for the perpendicular actuator. The result of this approach is that the switch typically has a better performance over a wide frequency band.

In some designs the piezoelectric cantilever is configured perpendicular to a CPW. However, this design utilizes bulk silicon micromachining which is generally regarded as an expensive fabrication process in the industry and typically has difficulty being integrated with other fabrication technologies. Accordingly, there remains a need for a new RF MEMS switch capable of being fabricated relatively easy and providing improved results in operation and increased uses of application.

SUMMARY

In view of the foregoing, an embodiment provides a MEMS switch comprising a RF transmission line; a structurally discontinuous RF conductor adjacent to the RF transmission line; a pair of cantilevered piezoelectric actuators flanking the RF conductor; a contact pad connected to the pair of cantilevered piezoelectric actuators; a pair of cantilevered structures connected to the RF conductor; a plurality of air bridges connected to the pair of cantilevered piezoelectric actuators; and a plurality of contact dimples on the contact pad. Preferably, the RF transmission line comprises a pair of co-planar waveguide ground planes flanking the RF conductor; and a plurality of ground straps connected to the pair of co-planar waveguide ground planes, wherein the RF transmission line is operable to provide a path along which RF signals propagate. Furthermore, each cantilevered piezoelectric actuator preferably comprises an elastic layer; a bottom electrode connected to the elastic layer; a top electrode; and a piezoelectric layer in between the top and bottom electrodes, wherein the top electrode is offset from an edge of the piezoelectric layer and the bottom electrode. Moreover, the pair of cantilevered piezoelectric actuators are preferably structurally isolated from the RF conductor. Additionally, voltage applied to the pair of cantilevered piezoelectric actuators preferably causes vertical deflection of the pair of cantilevered piezoelectric actuators thereby causing the contact pad to contact the pair of cantilevered structures thereby providing a continuous path for allowing a RF signal to propagate through the RF conductor. Also, a first one of the plurality of air bridges preferably connects to the top electrode and a second one of the plurality of air bridges connects to the piezoelectric layer. Furthermore, the contact dimples are preferably positioned beneath a free end of each of the pair of cantilevered structures. Moreover, the RF conductor is preferably mechanically stationary.

Another embodiment provides a MEMS switch comprising a RF transmission line; a RF conductor adjacent to the RF transmission line, wherein the RF conductor comprises a first section spaced apart from a second section; at least one cantilevered piezoelectric actuator spaced apart from the RF conductor; a first contact element connected to the at least one cantilevered piezoelectric actuator; a second contact element connected to the first section of the RF conductor; and a third contact element connected to the second section of the RF conductor. Preferably, the RF transmission line comprises a pair of co-planar waveguide ground planes flanking the RF conductor; and a plurality of ground straps connected to the pair of co-planar waveguide ground planes, wherein the RF transmission line is operable to provide a path along which RF signals propagate. Also, each cantilevered piezoelectric actuator preferably comprises an elastic layer; a bottom electrode connected to the elastic layer; a top electrode; and a piezoelectric layer in between the top and bottom electrodes, wherein the top electrode is offset from an edge of the piezoelectric layer and the bottom electrode. The MEMS switch may further comprise a plurality of air bridges connected to the at least one cantilevered piezoelectric actuator; and a plurality of contact dimples on the first contact element. Preferably, voltage applied to the at least one cantilevered piezoelectric actuator causes vertical deflection of the at least one cantilevered piezoelectric actuator thereby causing the first contact element to contact each of the second and third contact elements thereby providing a continuous path for allowing a RF signal to propagate through the RF conductor. Additionally, a first one of the plurality of air bridges preferably connects to the top electrode and a second one of the plurality of air bridges connects to the piezoelectric layer. Furthermore, the contact dimples may be positioned beneath a free end of each of the second and third contact elements. Preferably, the RF conductor is mechanically stationary.

Another embodiment provides a method of fabricating a MEMS switch, wherein the method comprises forming a RF transmission line; forming a RF conductor adjacent to the RF transmission line, wherein the RF conductor comprises a first section spaced apart from a second section; configuring at least one cantilevered piezoelectric actuator to be spaced apart from the RF conductor; connecting a first contact element to the at least one cantilevered piezoelectric actuator; connecting a second contact element to the first section of the RF conductor; and connecting a third contact element to the second section of the RF conductor. Preferably, the formation of the RF transmission line comprises flanking a pair of co-planar waveguide ground planes adjacent to the RF conductor; and connecting a plurality of ground straps to the pair of co-planar waveguide ground planes, wherein the RF transmission line is operable to provide a path along which RF signals propagate. Moreover, the configuration of each cantilevered piezoelectric actuator preferably comprises providing an elastic layer; connecting a bottom electrode to the elastic layer; connecting a piezoelectric layer on the bottom electrode; connecting a top electrode on the piezoelectric layer; and offsetting the top electrode from an edge of the piezoelectric layer and the bottom electrode. The method may further comprise connecting a plurality of air bridges to the at least one cantilevered piezoelectric actuator; and forming a plurality of contact dimples on the first contact element. Preferably, voltage applied to the at least one cantilevered piezoelectric actuator causes vertical deflection of the at least one cantilevered piezoelectric actuator thereby causing the first contact element to contact each of the second and third contact elements thereby providing a continuous path for allowing a RF signal to propagate through the RF conductor. Also, the method may further comprise connecting a first one of the plurality of air bridges to the top electrode; and connecting a second one of the plurality of air bridges to the piezoelectric layer. Moreover, the method may further comprise positioning the contact dimples beneath a free end of each of the second and third contact elements. Preferably, the method further comprises forming the RF conductor to be mechanically stationary.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1:
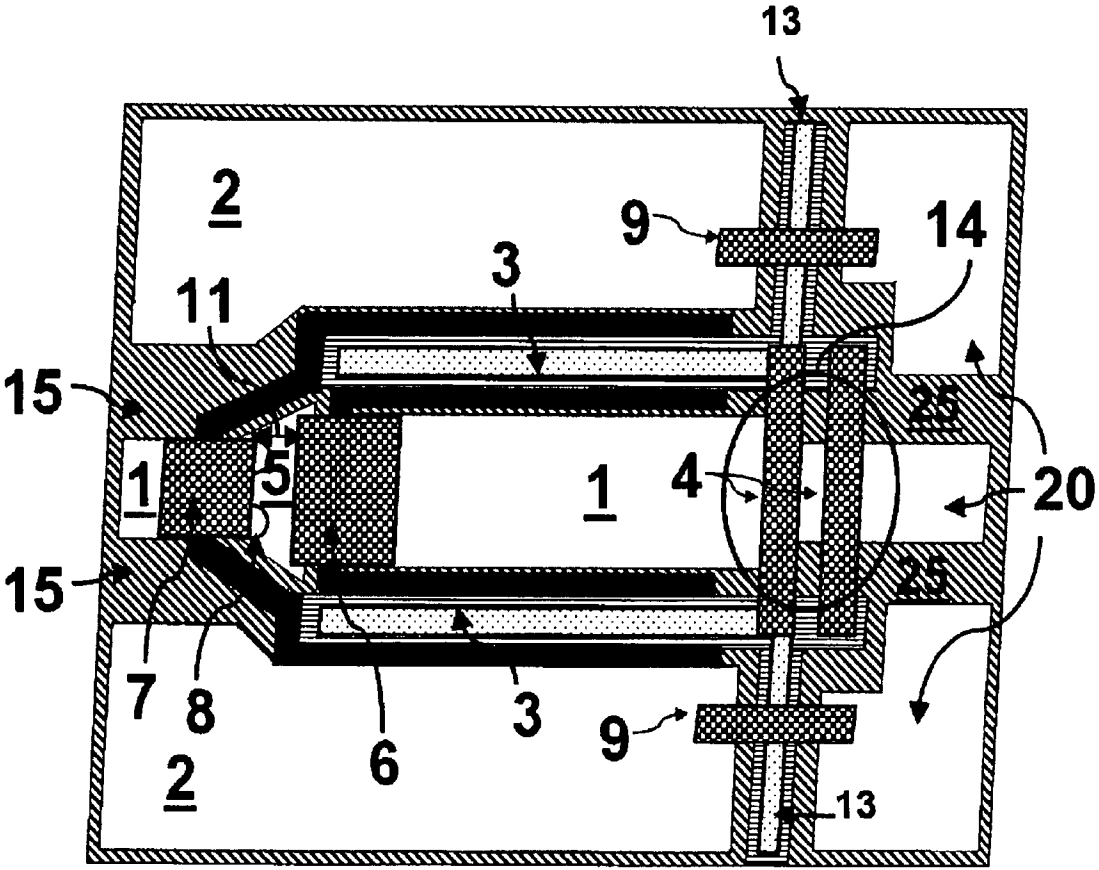
FIG. 1 is a magnified scanning electron microscopy representation illustrating an RF series switch according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for a new RF MEMS switch capable of being fabricated relatively easy and providing improved results in operation and increased uses of application. The embodiments herein achieve this by providing a RF MEMS series switch and method of fabrication that overcomes the limitations of the conventional devices and techniques. Referring now to the drawings, and more particularly to FIGS. 1 through 16, where similar reference characters denote corresponding features consistently throughout the figures, there are shown preferred embodiments.

The various thicknesses described herein for the various materials are approximate and may be altered depending on design choices/optimization. Furthermore, the materials described herein to form the devices provided by the embodiments are given as preferred embodiments and are not the only possible materials which can be successfully used in accordance with the embodiments herein.

As shown in FIG. 1, a RF MEMS series switch 100 comprises piezoelectric actuators 3 and turns on and off RF signals that are propagating along an RF transmission line 20. The actuators 3 function as basic RF circuit elements that are used as components in larger RF circuits, such as RF phase shifters. The RF MEMS series switch 100 uses a CPW configuration for the transmission line 20 and the switch 100 includes a center RF conductor 1 flanked by two ground planes 2. The transmission line 20 is the path along which RF signals propagate in the switch 100. Preferably, the transmission line 20 is dimensioned and configured in a generally common geometry as known to those skilled in the art, although other geometries are also possible with minor modifications.

Figure 2A:
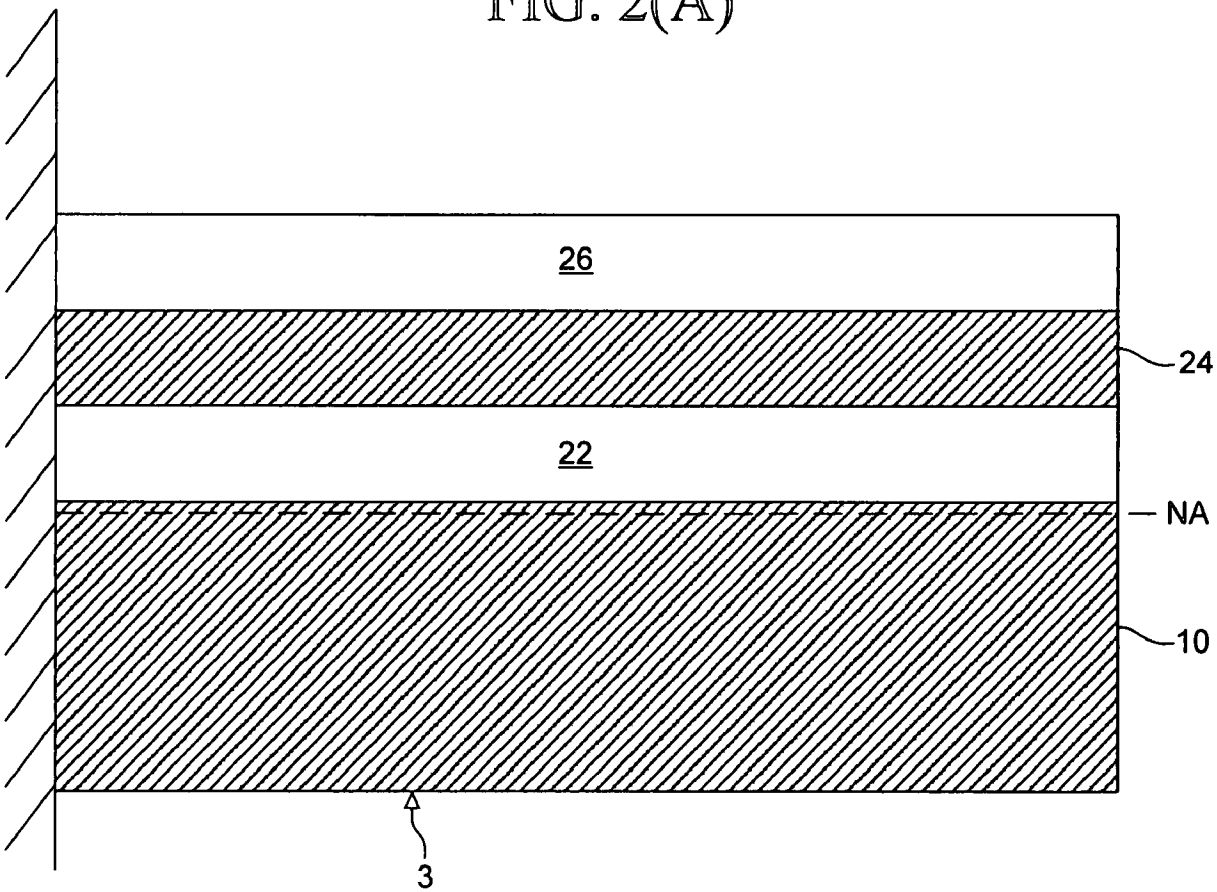
FIGS. 2(A) and 2(B) are cross-sectional diagrams illustrating an actuator of the RF series switch of FIG. 1 according to an embodiment herein.

Preferably, the two piezoelectric actuators 3, which provide the motion for the switch 100, are embodied as piezoelectric unimorph actuators 3 and are mechanically coupled to a RF contact pad 5 comprising a passive structural elastic layer 10 (shown in FIG. 2(A)). The actuators 3 reside in the gaps 15 of the CPW RF transmission line 20. The approximately "U" shaped switch 100 comprises the actuators 3 and RF contact pad 5 and is attached to a elastic composite thin film layer 102, which is attached to a silicon substrate 25 (best shown in FIG. 3) at the ends of each of the actuators 3 but otherwise are released from the elastic composite thin film layer 102 and is free to move. There is a gap 111 in the center RF conductor 1 and the RF contact pad 5 resides within this gap 11.

In addition, two RF cantilevers, RF-in 6 and RF-out 7, which are constructed using a sacrificial layer 107 (shown in FIGS. 10(A) through 12(B) and as further described below), are attached to the open ends of the RF center conductor 1 and overhang portions of the RF contact pad 5. The RF-in and RF-out cantilevers 6, 7, respectively, allow a vertical deflection of the actuators 3 to close the gap 11 between the discontinuous section of the center RF conductor 1.

Figure 2B:
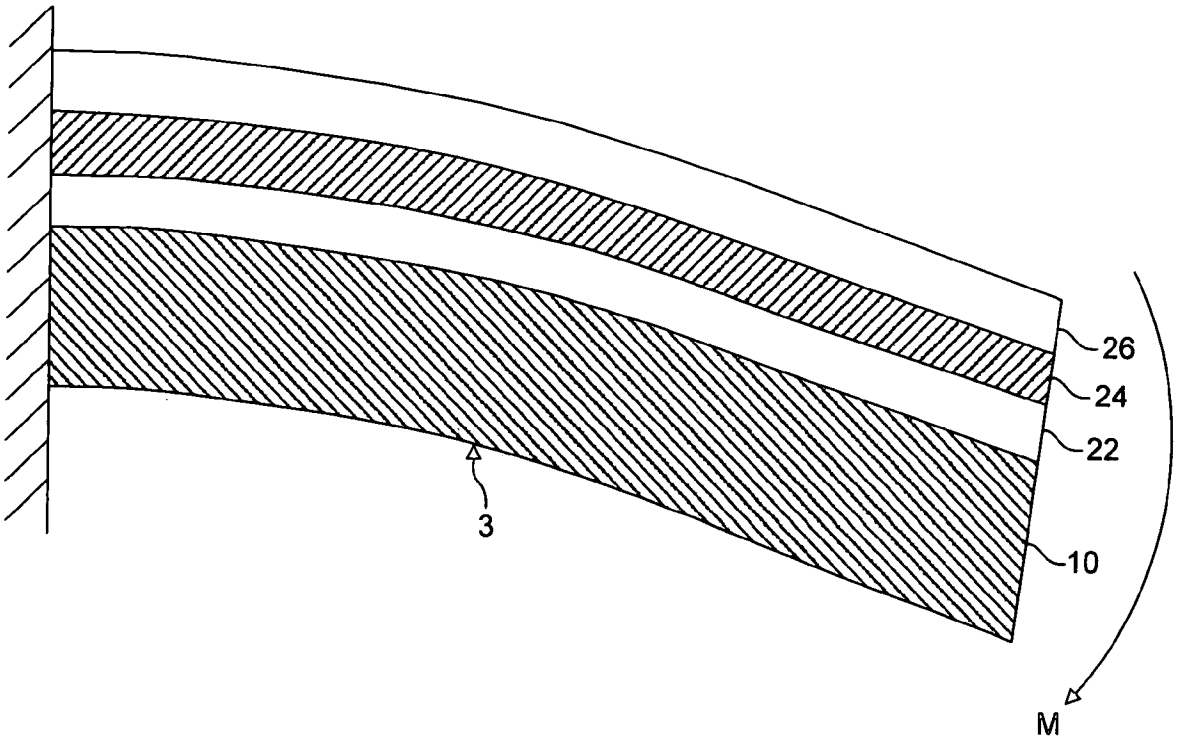
Figure 2C:
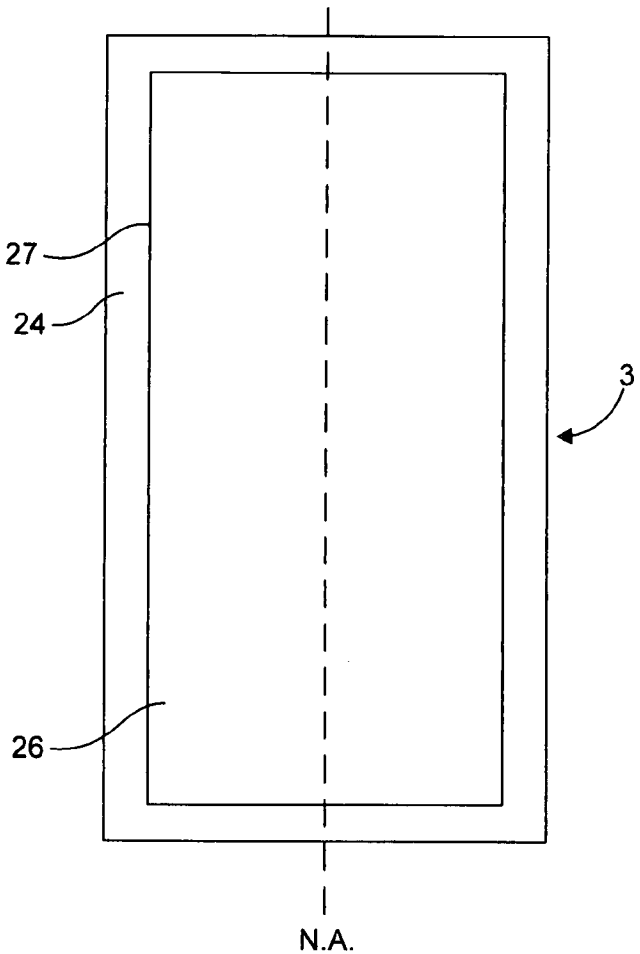
FIG. 2(C) is a schematic top view of FIGS. 2(A) and 2(B) according to an embodiment herein.

With respect to FIGS. 1 through 2(C), when a voltage is applied between the electrodes 22, 26 positioned on a passive structural elastic layer 10 of each of the piezoelectric actuators 3, the piezoelectric material 24 deforms. This strain (deformation), when asymmetric about the neutral axis (N.A.) of each of the actuators 3, generates a bending moment M that causes the actuators 3 and RF contact pad 5 to bend toward or away from the RF-in and RF-out cantilevers 6, 7, respectively. In this manner, the mechanical/electrical contact may be closed, allowing the RF signal to propagate through the switch 100. When the switch 100 is not in mechanical contact, the air gap 111 in the center RF conductor 1 impedes the transmission of the RF signal and the switch 100 turns off. When the RF contact pad 5 is in mechanical contact with the RF-in 6 and RF out 7 cantilevers, the ohmic contact path allows for the transmission of the RF signal and the switch 100 turns on.

The RF contact pad 5 comprises the passive structural elastic layer 10 joining both actuators 3 and a portion of the RF conductor 1 which, when the actuators 3 deform upward, contact both of the overhanging RF cantilevers 6, 7. The elastic layer 10 serves to make the piezoelectric actuation strain asymmetric relative to the neutral axis of each actuator 3. Preferably, the top electrode 26 covers nearly the entire beam-like actuator 3 for proper actuation. Additionally, the top electrode 26 is preferably offset from the edge of the main sidewall 27 of the actuator 3 to decrease the electric field in the air between the top and bottom electrodes 26, 22, respectively. This increases the breakdown voltage of the actuators 3 and thus permits larger voltages to be applied.

The piezoelectric actuators 3 function as follows. The piezoelectric materials 24 deform (strain) when in the presence of an electric field. The piezoelectric actuators 3 are preferably embodied in a beam-like configuration, and like all mechanical beam-like structures, possess a neutral axis. The neutral axis is the location within each of the actuators 3 where there is equal contribution to structural stiffness (resistance to deformation) on either side of the axis. When a voltage is applied between the electrodes 22, 26 of the piezoelectric actuators 3, the piezoelectric material 24 deforms.

This strain (deformation), when asymmetric about the neutral axis of the actuator 3, generates a bending moment M that causes the actuator 3 to bend. The direction in which the actuator 3 moves is dependant upon many factors, but largely due to the magnitude of the electric field and the relative position of the midplane of the active piezoelectric material 24 with respect to the neutral axis of the actuators 3. Below a critical electric field value, the sense of the piezoelectric strain can be switched by changing the polarity of the applied field. However, above that critical electric field value, the sense of the strain is independent of field polarity.

Again with respect to FIG. 1, the ground straps 9 tie adjacent sections of the ground planes 2 to one another, around the bias line and bond pads 13, to minimize the impact of the ground plane geometric discontinuity on the characteristic impedance of the transmission line 20. The bias line and bond pads 13 function as the electrodes for applying voltage to generate the piezoelectric actuation, and comprise the same material structure as the piezoelectric actuators 3. The RF contact pad 5 is formed of an elastic layer comprising silicon dioxide and silicon nitride having a conductive metal thin film deposited on top. The RF contact pad 5 is mechanically coupled to piezoelectric actuators 3 as shown in FIG. 1, and the actuators 3 move the RF contact pad 5 into contact with the RF-in and RF-out cantilevers 6, 7, respectively. The contact dimples 8 are generally small features, preferably embodied in a cylindrical configuration, and are located on the RF contact pad 5 and beneath each of the RF-in and RF-out cantilevers, 6, 7, respectively. The contact dimples 8 serve as the location of actual mechanical/electrical contact material for the switch 100. Preferably, platinum is used as the contact material with a gold adhesion under-layer, although other suitable materials are possible.

Figure 15A:
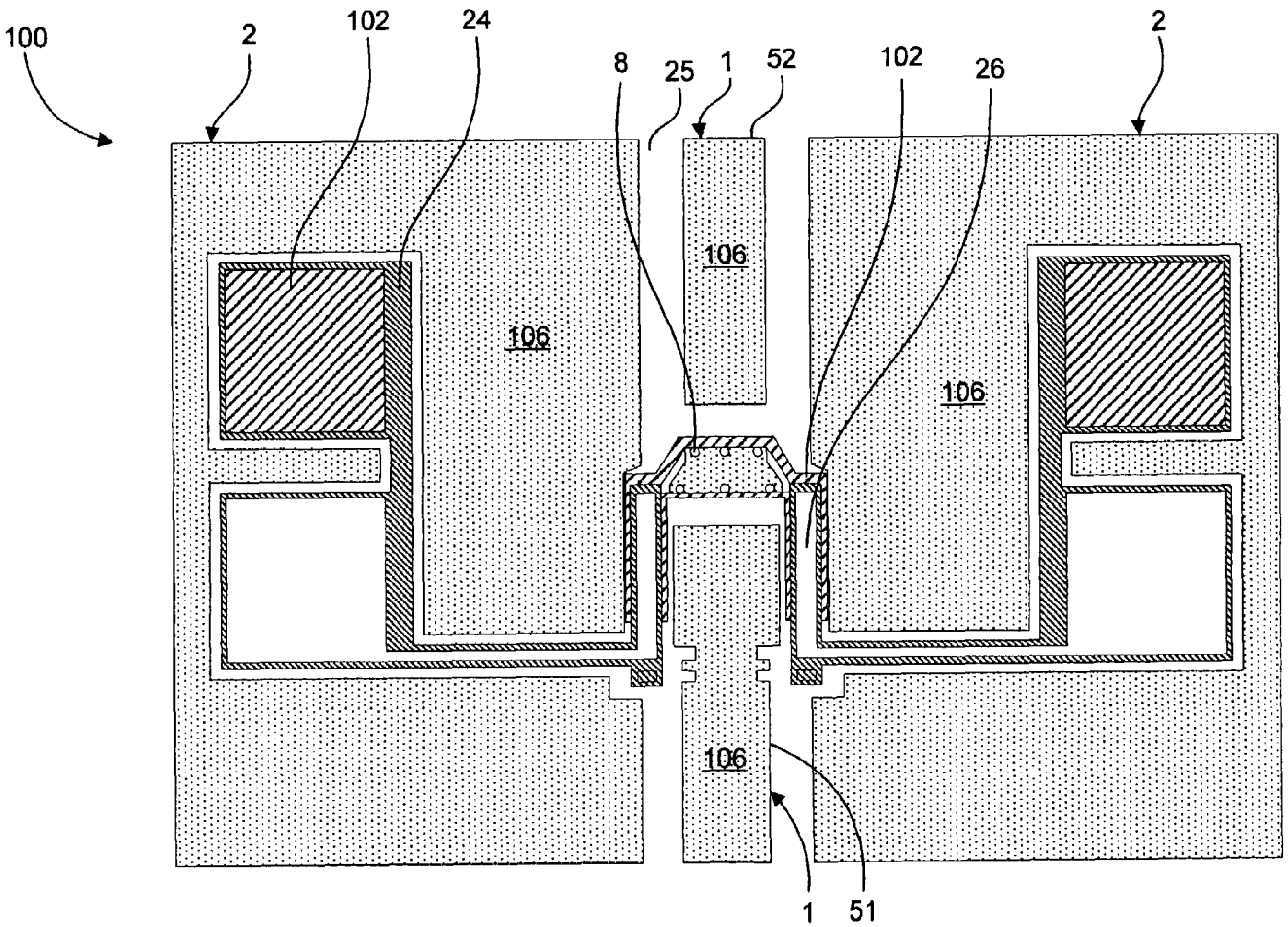
FIG. 15(A) is a schematic top view illustrating the RF series switch of FIG. 1 according to an embodiment herein.
Figure 15B:
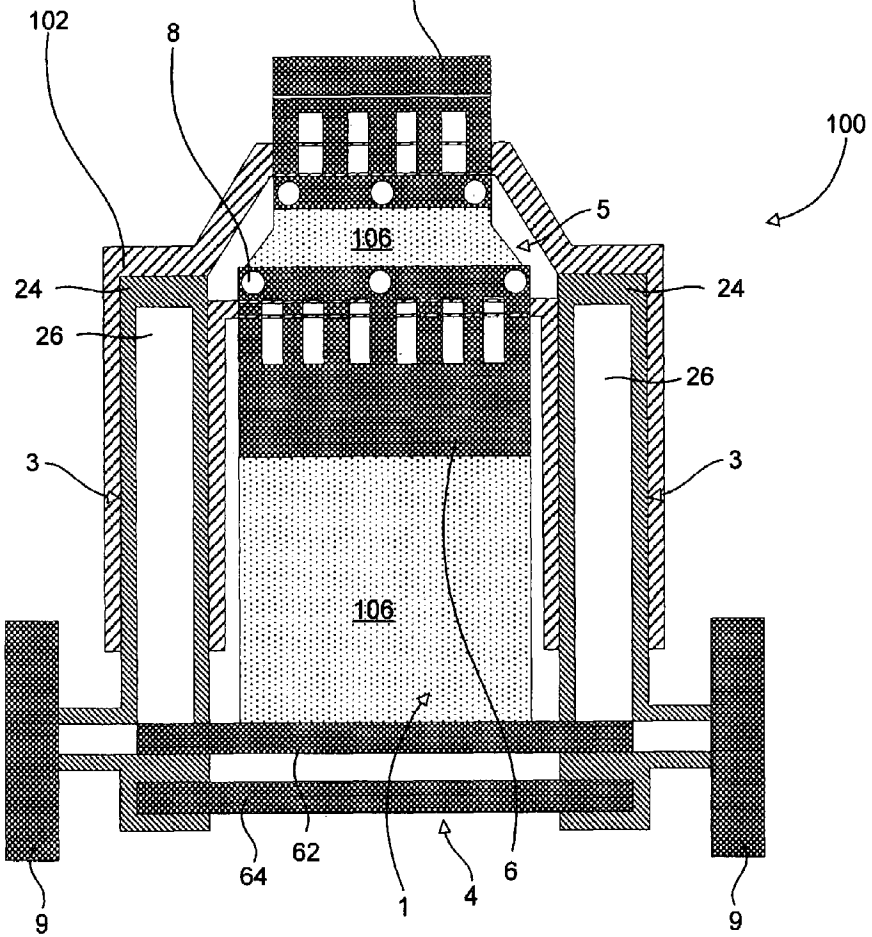
FIG. 15(B) is a magnified schematic top view illustrating the RF series switch of FIG. 15(A) according to an embodiment herein.

The switch 100 further includes top and bottom electrode bias line air bridges 62, 64 (best shown in FIG. 15(B) but collectively shown in FIG. 1 as air bridges 4) that are embodied as elevated clamped-clamped beams that span the anchored region 14 of the switch 100 and are themselves anchored on the top 26 and bottom 22 electrodes of the actuators 3. The air bridges 4 electrically tie both actuators 3 together. Moreover, the air bridges 4, which are constructed using a sacrificial layer 107 (shown in FIGS. 10(A) through 12(B) and as further described below), allow for the actuation of the switch 100 with only one set of bias lines and bond pads 13. This facilitates employing the switch 100 in RF circuits.

Figure 3:
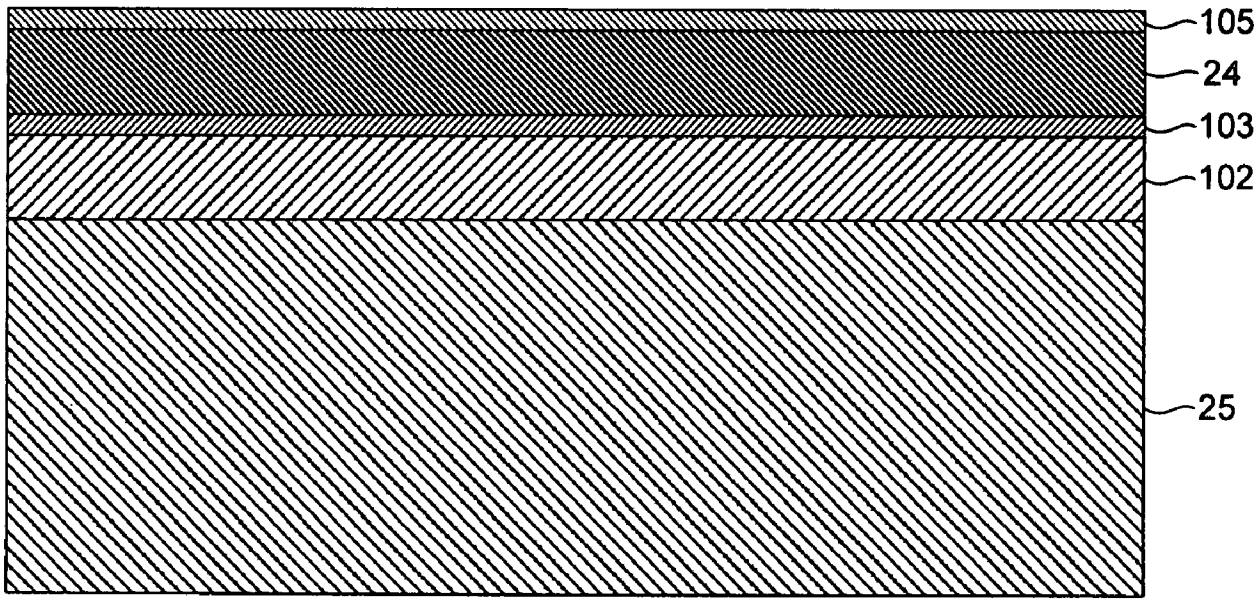
FIG. 3 is a schematic diagram illustrating a thin film stack on a high resistivity silicon substrate during an intermediate processing step according to an embodiment herein.

The switch 100 may be fabricated as follows. As shown in FIG. 3, the starting material and substrate 25 is preferably embodied as a highly resistive (greater than approximately 10 kOhm-cm) single crystal silicon wafer. An elastic composite thin film layer 102 preferably comprising $SiO_2/Si_3N_4/SiO_2$ is deposited over the substrate 25 using plasma enhanced chemical vapor deposition (PECVD). The thin film layer 102 may be dimensioned and configured with the following approximate thicknesses 1000 Å/500 Å/3500 Å for the respective $SiO_2/Si_3N_4/SiO_2$ materials. The PECVD preferably occurs at approximately 250° C. after which the thin film layer 102 is annealed preferably at approximately 700° C., in a $N_2$ atmosphere, with an approximately 60 second annealing cycle. Next, a DC sputtered $Ti/TiO_2/Pt/TiO_2$ layer 103 is deposited having respective approximate thicknesses of 10 Å/200 Å/850 Å/20 Å. The DC sputtering preferably occurs at approximately 500° C. Next, a sol-gel $PZ_{0.52}T_{0.48}$ (PZT) layer 24 having an approximate thickness of 5,000 Å is deposited in a repetitive process of spinning and pyrolyzing preferably at 350° C. for approximately 120 seconds. After approximately four spins and pyrolysis cycles, the PZT layer 24 is crystallized at approximately 700° C., in an air atmosphere, with an approximate 30 second annealing cycle for each approximate 2,500 Å for a total of 5,000 Å. Then, a Pt layer 105 is DC sputtered at an approximate thickness of 1,050 Å at a deposition temperature of approximately 350° C.

Figure 4B:
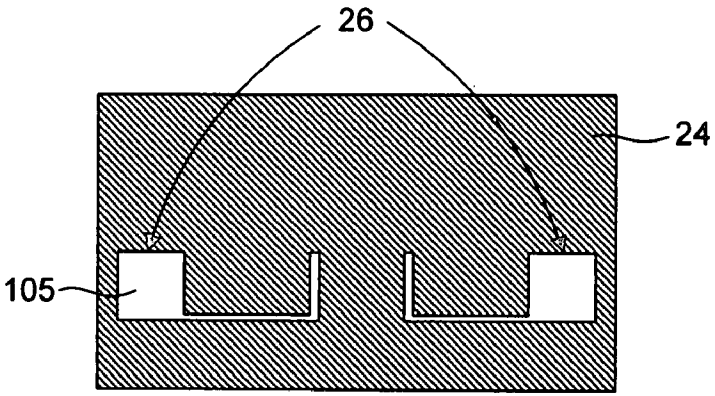
FIG. 4(B) is a schematic top view of FIG. 4(A) according to an embodiment herein.
Figure 4A:
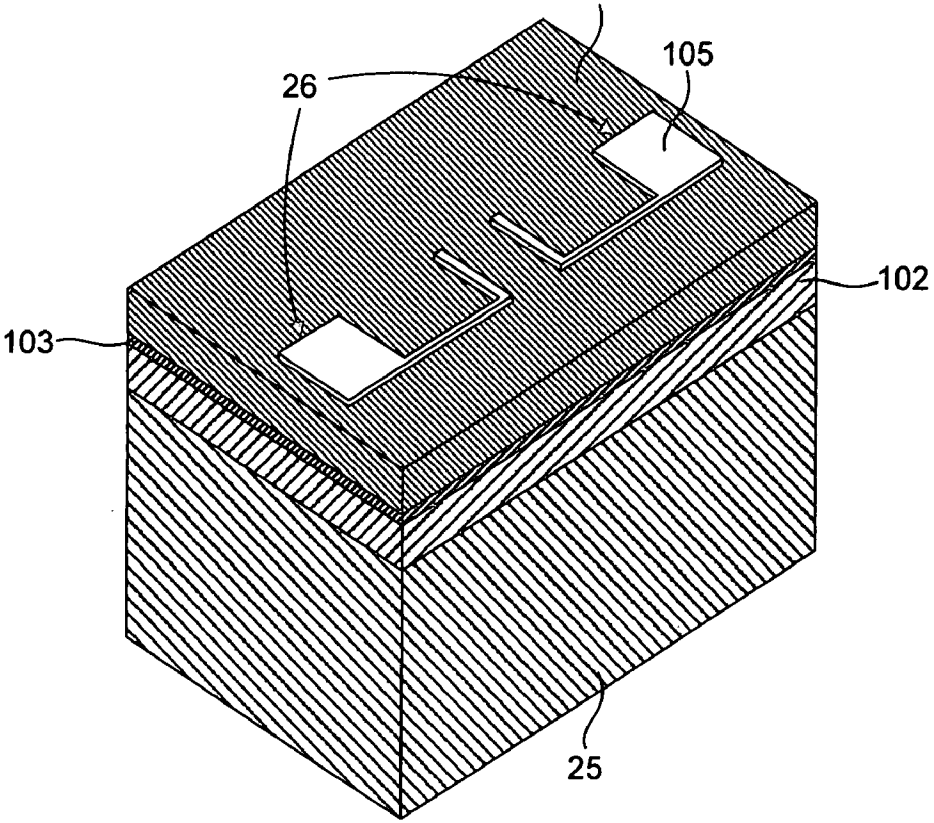
FIG. 4(A) is a schematic perspective view illustrating top electrode pattering during an intermediate processing step for fabricating the RF series switch of FIG. 1 according to an embodiment herein.

Next, as shown in FIGS. 4(A) and 4(B), the top electrode 26 of the actuator 3 is formed. Here, a photolithography process occurs wherein a photoresist mask (not shown) is applied to the Pt layer 105 in all areas except the location of the top electrode. An argon ion-mill process is applied to the top Pt layer 105 at a preferred angle of incidence of approximately 85° for most of the Pt layer 105 thickness with the remainder removed at an approximate 50° angle for approximately 30 seconds to reveal the underlying PZT layer 24. Next, the photoresist mask (not shown) is removed, preferably with an oxygen plasma, which results in the formation of the top electrode 26 (which comprises Pt layer 105). After resist removal, the wafer undergoes an anneal procedure in an approximate 350° C. air atmosphere, with an approximately 120 second annealing cycle.

Figure 5A:
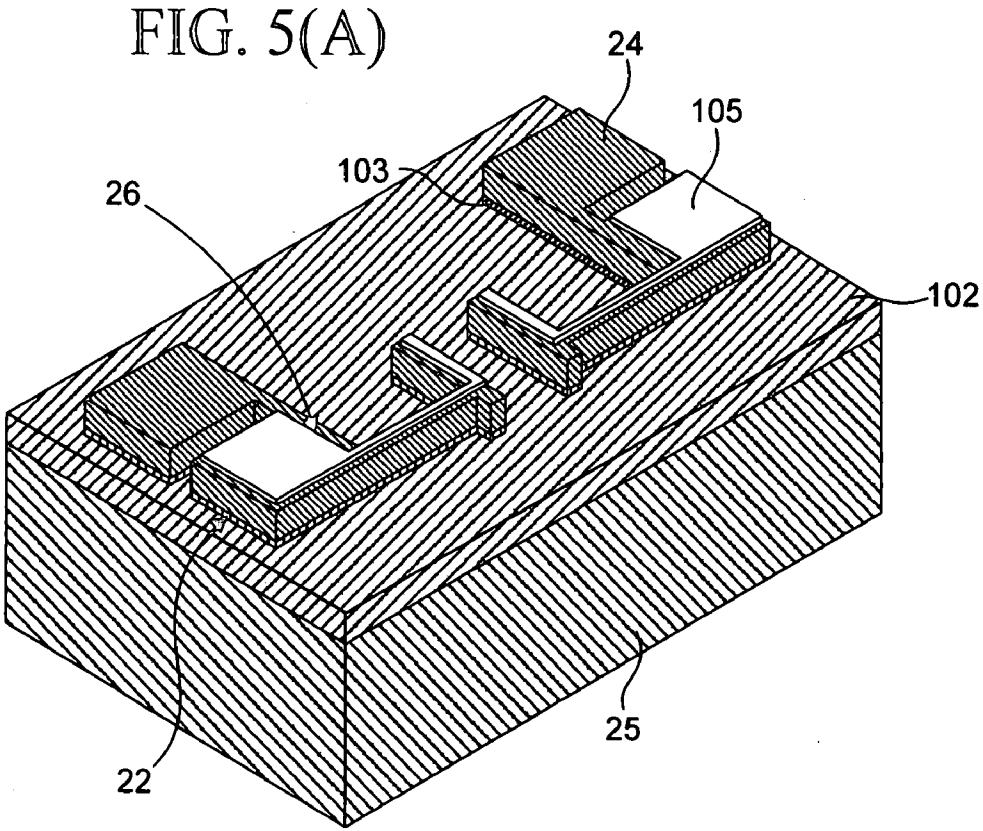
FIG. 5(A) is a schematic perspective view illustrating PZT and bottom electrode patterning during an intermediate processing step for fabricating the RF series switch of FIG. 1 according to an embodiment herein.
Figure 5B:
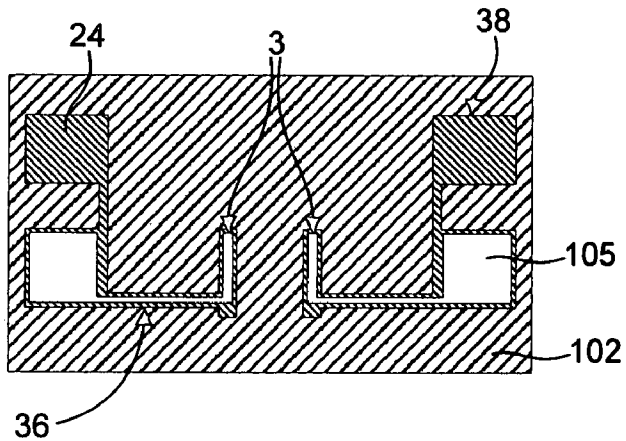
FIG. 5(B) is a schematic top view of FIG. 5(A) according to an embodiment herein.

In FIGS. 5(A) and 5(B), the PZT layer 24 and location of the bottom electrode 22 are patterned. Here, a photolithography process occurs wherein a photoresist mask (not shown) is applied to the top electrode 26 and portions of the PZT layer 24 in order to define the location of the actuators 3. An argon ion-mill process is applied to the PZT layer 24 and bottom electrode 22 at a preferred angle of incidence of approximately 85° for most of the layer thickness with the remainder removed at an approximate 50° angle for approximately 30 seconds to reveal the underlying elastic layer 10. The ion mill etching process defines the actuator 3, bias lines 36, and bond pads 38. Next, the photoresist mask (not shown) is removed using oxygen plasma.

Figures 6A, 6B:
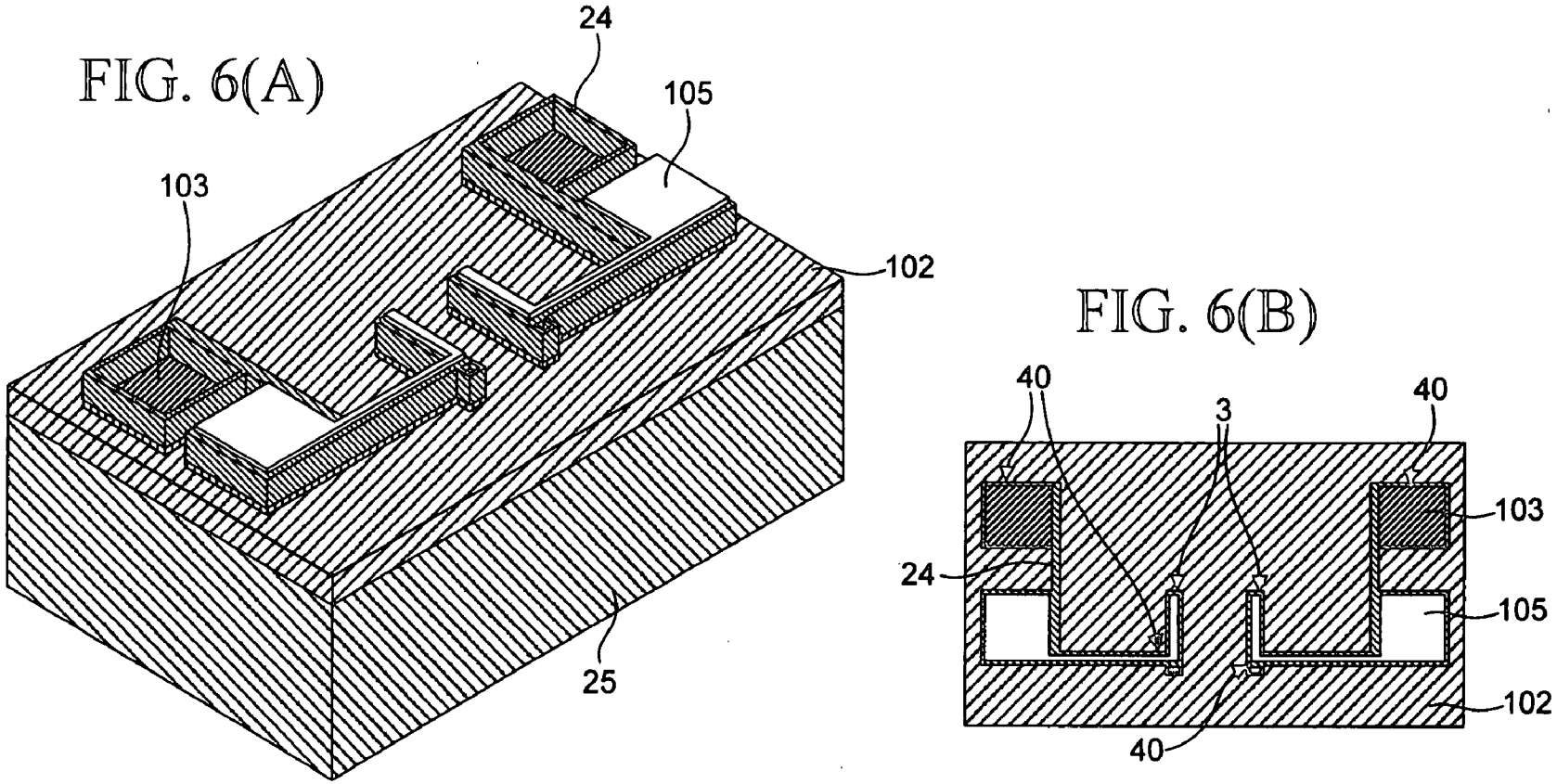
FIG. 6(A) is a schematic perspective view illustrating bottom electrode bond pad definition during an intermediate processing step for fabricating the RF series switch of FIG. 1 according to an embodiment herein.
FIG. 6(B) is a schematic top view of FIG. 6(A) according to an embodiment herein.

In FIGS. 6(A) and 6(B) the PZT layer 24 undergoes a wet etching process. Here, a photolithography process occurs wherein a photoresist mask (not shown) is applied to the entire device except at the bottom electrode contact locations 40. Then, the exposed PZT layer 24 is removed in a wet etching process preferably using $H_2O$:HCl:HF in a respective 2:1:0.04 ratio. Then, the photoresist mask (not shown) is removed using oxygen plasma.

Figure 7B:
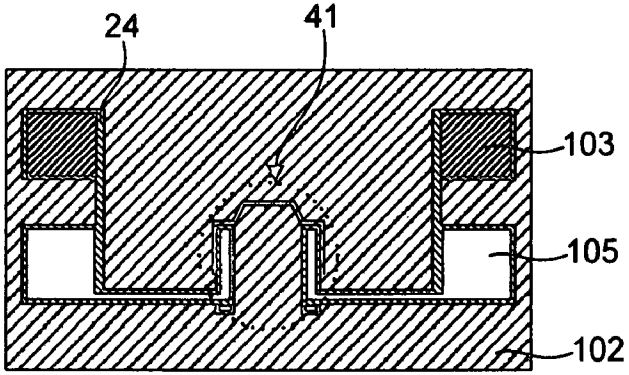
FIG. 7(B) is a schematic top view of FIG. 7(A) according to an embodiment herein.
Figure 7A:
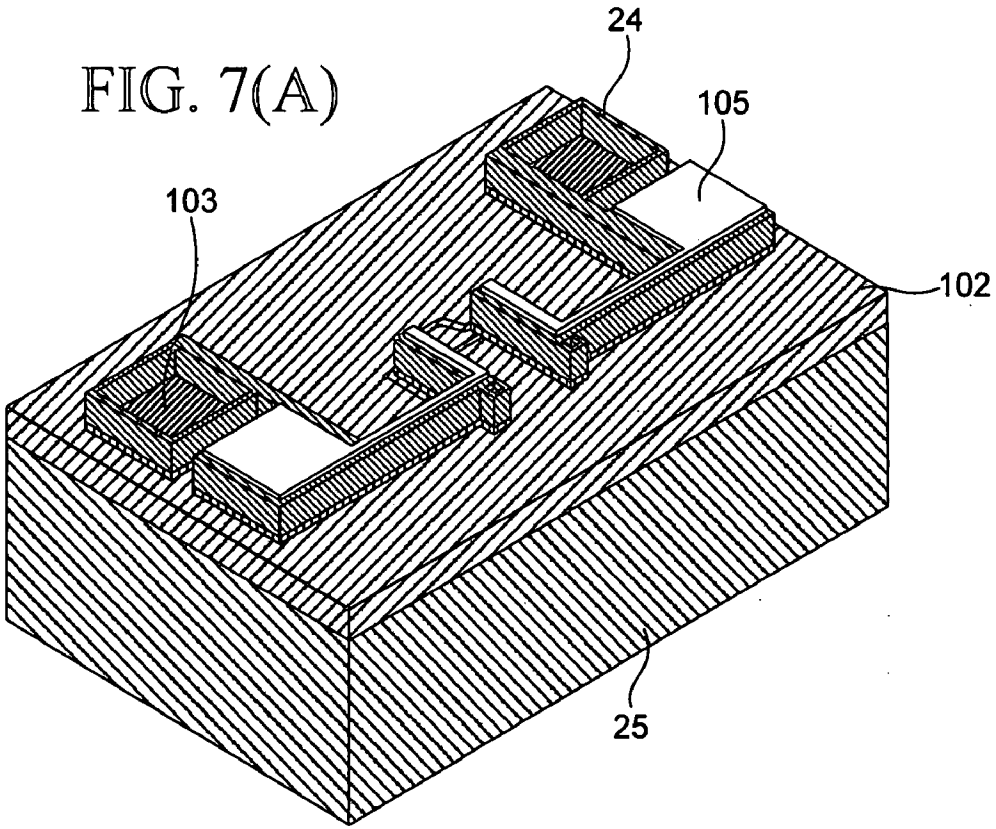
FIG. 7(A) is a schematic perspective view illustrating structural elastic layer patterning during an intermediate processing step for fabricating the RF series switch of FIG. 1 according to an embodiment herein.

In the next step in the formation process, the elastic composite thin film layer 102 is patterned as indicated in FIGS. 7(A) and 7(B). Here, a photolithography process occurs wherein a photoresist mask (not shown) is applied to the entire device except at region 41 (denoted by the outline regions within the dotted circle in FIG. 7(B)), which shall eventually outline the location of the actuators 3 and RF contact pad 5 (of FIG. 1). The elastic composite thin film layer 102 undergoes reactive ion etching preferably using a combination of $CHF_3$, $CF_4$, and He gases to pattern region 41 and thereby form the location for the actuators 3 and RF contact pad 5 (of FIG. 1). Then, the photoresist mask (not shown) is removed using oxygen plasma.

Figures 8A, 8B:
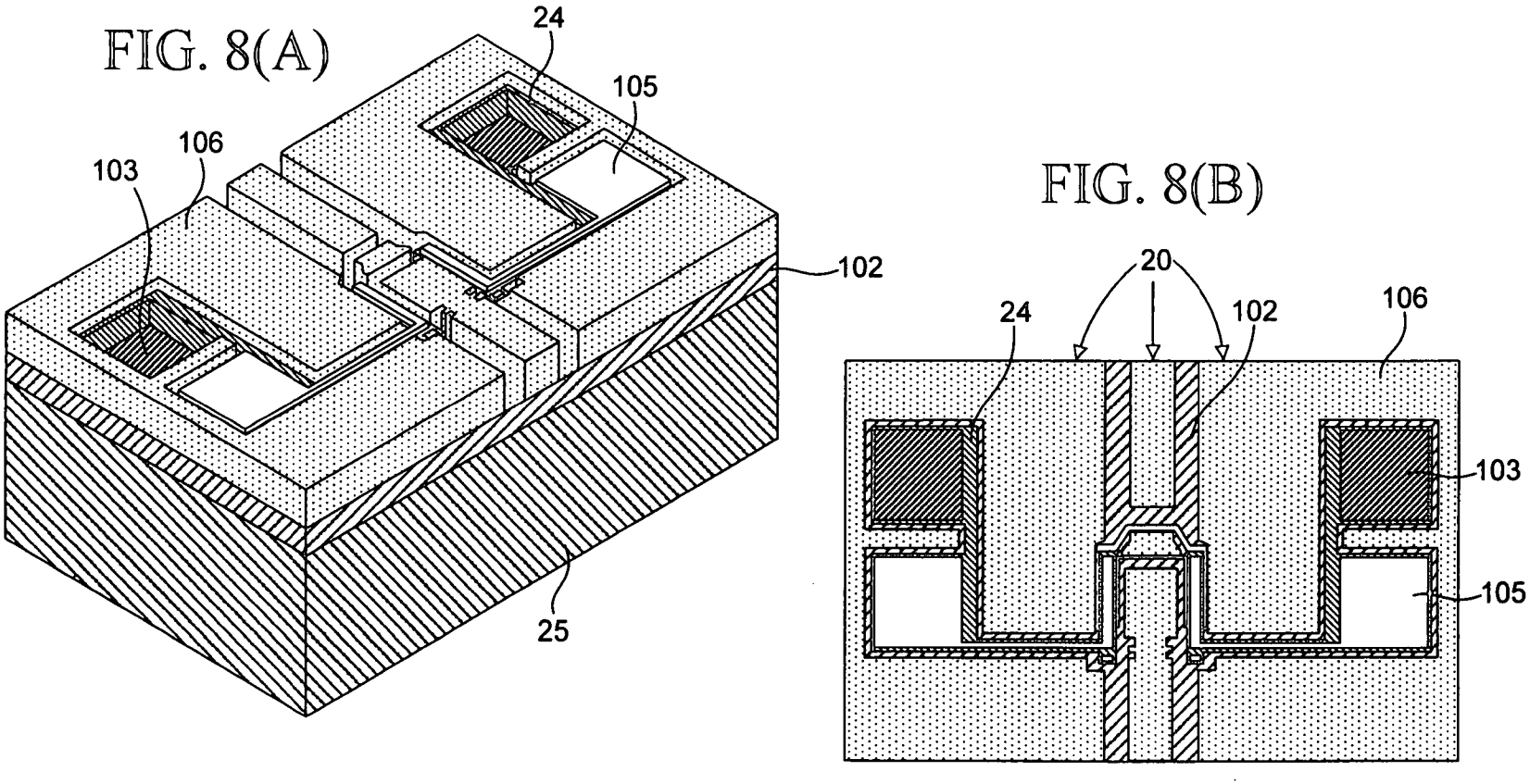
FIG. 8(A) is a schematic perspective view illustrating CPW transmission line deposition and patterning during an intermediate processing step for fabricating the RF series switch of FIG. 1 according to an embodiment herein.
FIG. 8(B) is a schematic top view of FIG. 8(A) according to an embodiment herein.

FIGS. 8(A) and 8(B) depict the formation of the CPW RF transmission line 20. In this step, a photolithography process occurs wherein a photoresist mask (not shown) is applied to the entire device except at the locations of the CPW RF transmission line 20. Thereafter, a liftoff process occurs with evaporated Ti/Au 106 to define the CPW RF transmission line 20. The Ti/Au layer 106 is preferably approximately 200 Å/7,300 Å in thickness, respectively.

Figure 9B:
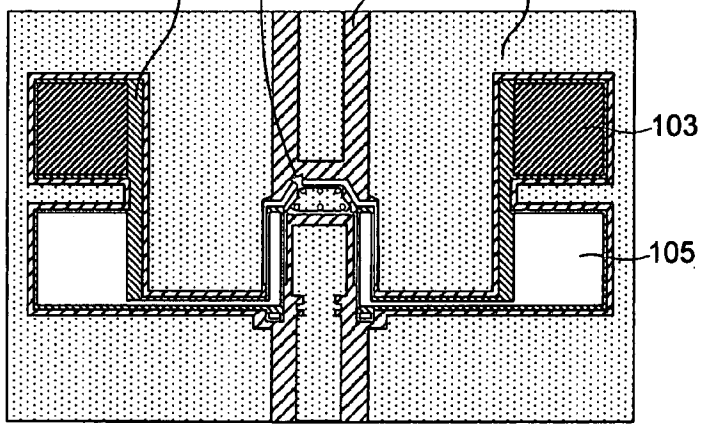
FIG. 9(B) is a schematic top view of FIG. 9(A) according to an embodiment herein.
Figure 9A:
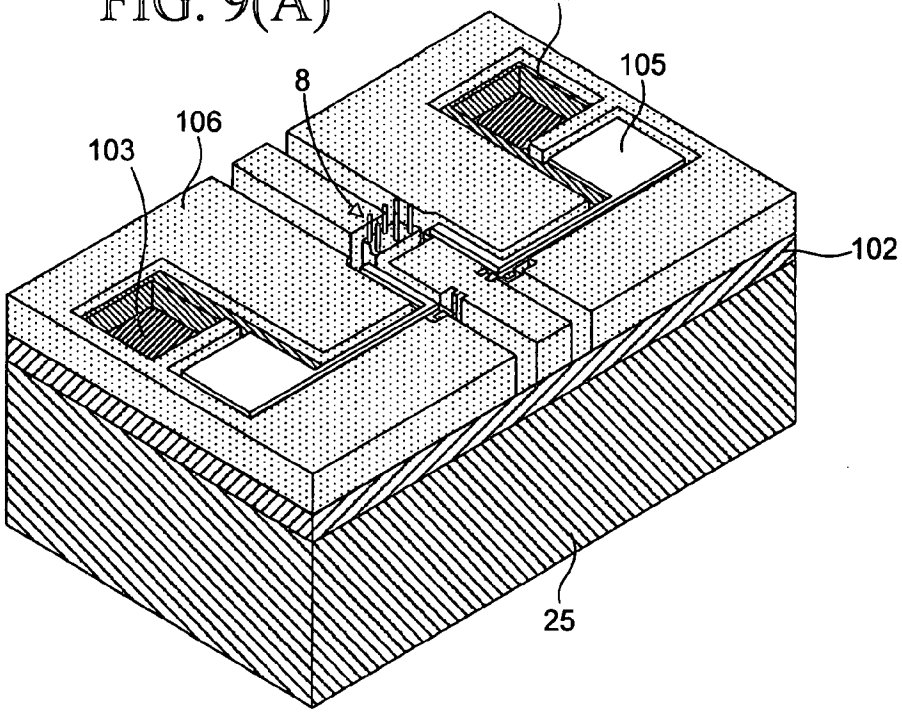
FIG. 9(A) is a schematic perspective view illustrating contact dimple deposition and patterning during an intermediate processing step for fabricating the RF series switch of FIG. 1 according to an embodiment herein.

As illustrated in FIGS. 9(A) and 9(B), the contact dimples 8 are defined. Here, a photolithography process occurs wherein a photoresist mask (not shown) is applied to the entire device except at the locations of the contact dimples 8. Upon completion of this step, a liftoff process occurs with evaporated Au/Pt to define the contact dimples 8. Preferably, the contact dimples 8 comprising the Au/Pt material is configured at an approximate respective thickness of 4,000 Å/1,000 Å.

Figure 10A:
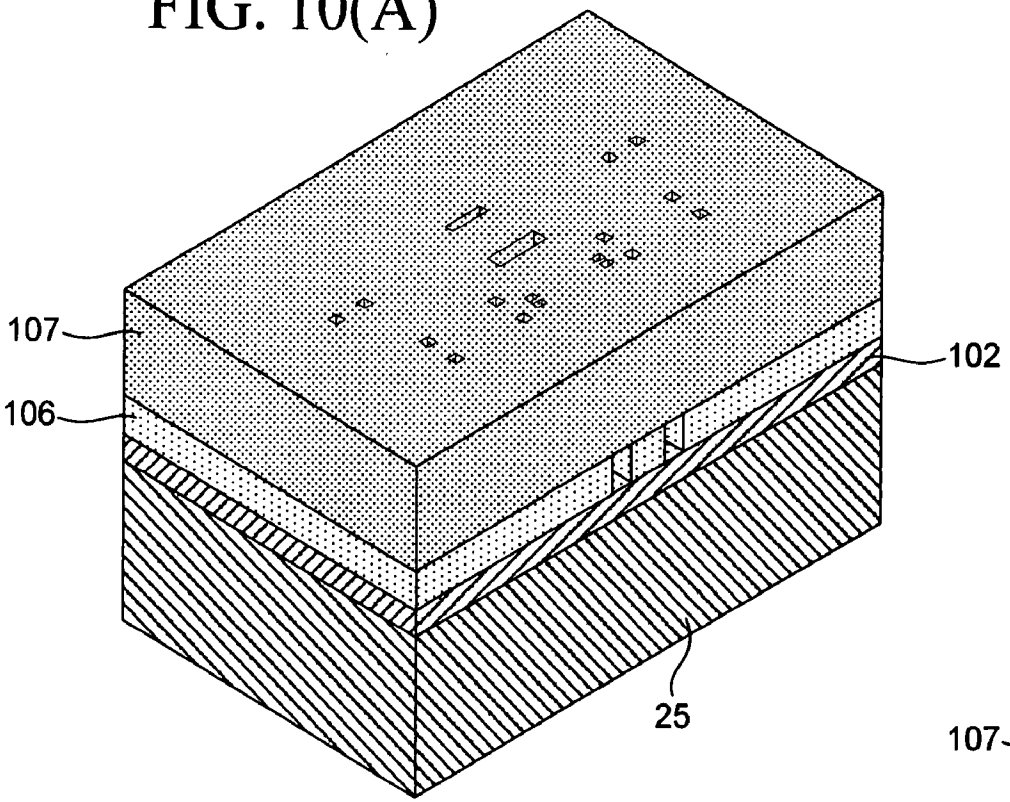
FIG. 10(A) is a schematic perspective view illustrating sacrificial layer deposition and patterning during an intermediate processing step for fabricating the RF series switch of FIG. 1 according to an embodiment herein.
Figure 10B:
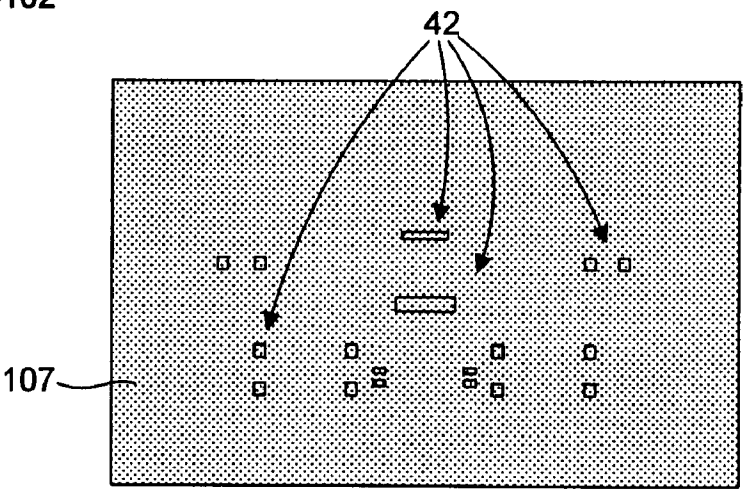
FIG. 10(B) is a schematic top view of FIG. 10(A) according to an embodiment herein.
Figure 11A:
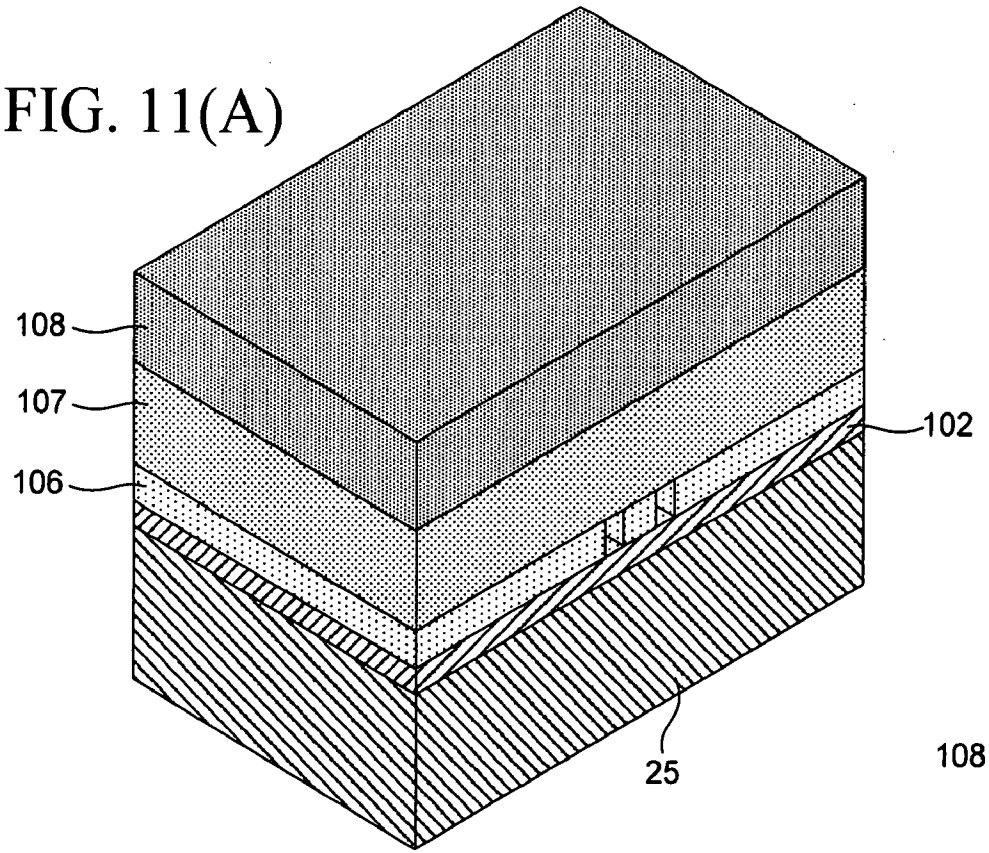
FIG. 11(A) is a schematic perspective view illustrating conformal (unpatterned) gold deposition during an intermediate processing step for fabricating the RF series switch of FIG. 1 according to an embodiment herein.
Figure 11B:
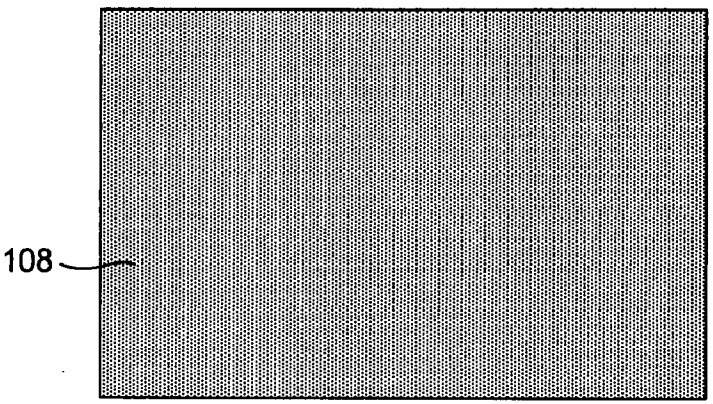
FIG. 11(B) is a schematic top view of FIG. 11(A) according to an embodiment herein.
Figures 12A, 12B:
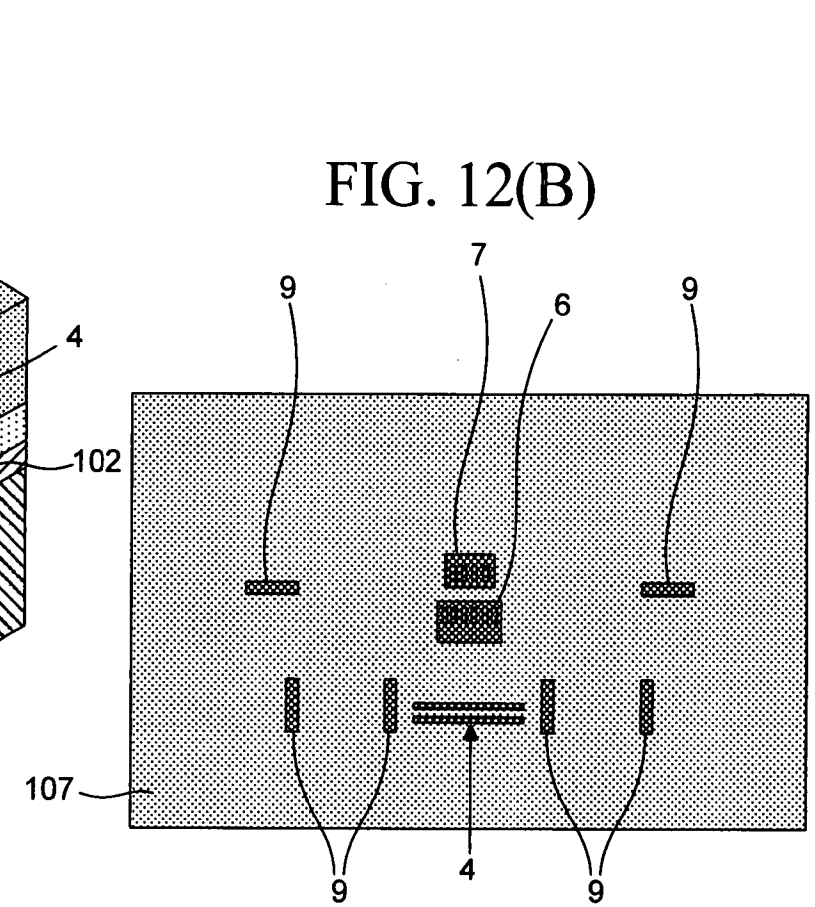
FIG. 12(A) is a schematic perspective view illustrating bridge metal patterning during an intermediate processing step for fabricating the RF series switch of FIG. 1 according to an embodiment herein.
FIG. 12(B) is a schematic top view of FIG. 12(A) according to an embodiment herein.

FIGS. 10(A) and 10(B) show the deposition of a sacrificial layer 107 and patterning using an ultra-violet radiation hardened photoresist (not shown). The patterning process opens spaces for vertical posts 42, which serve as anchors for the air bridges 4, RF cantilevers 6, 7, and ground straps 9 (of FIG. 1). Next, as shown in FIGS. 11(A) and 11(B), an evaporated Au layer 108 having an approximate thickness of 20,000 Å is deposited. Thereafter, as shown in FIGS. 12(A) and 12(B), an ion mill patterning of the Au layer 108 occurs to define the air bridges 4, RF cantilevers 6, 7, and ground straps 9.

As an alternative, the sacrificial layer 107 can be altered to allow for the creation of counter-dimples (not shown) along the top side of the sacrificial layer 107. The counter dimples (not shown) are preferably embodied as small hemispherical features that are patterned into the sacrificial layer 107 using a small exposure dose of ultra-violet (UV) light. The small exposure dose allows for the removal of a small portion of the sacrificial layer 107 during the development process. During a subsequent thermal process at approximately 175° C. and UV cure at approximately 200° C., the counter dimples (not shown) are converted from cylinders into hemispherical spheres. The next process is to pattern another photoresist layer (not shown) for the preparation of the deposition and subsequent patterning of the evaporated Au layer 108. The evaporated Au layer 108 has an approximate thickness of 20,000 Å and creates the eventual air bridges 4, RF cantilevers 6, 7, and ground straps 9.

Figures 13A, 13B:
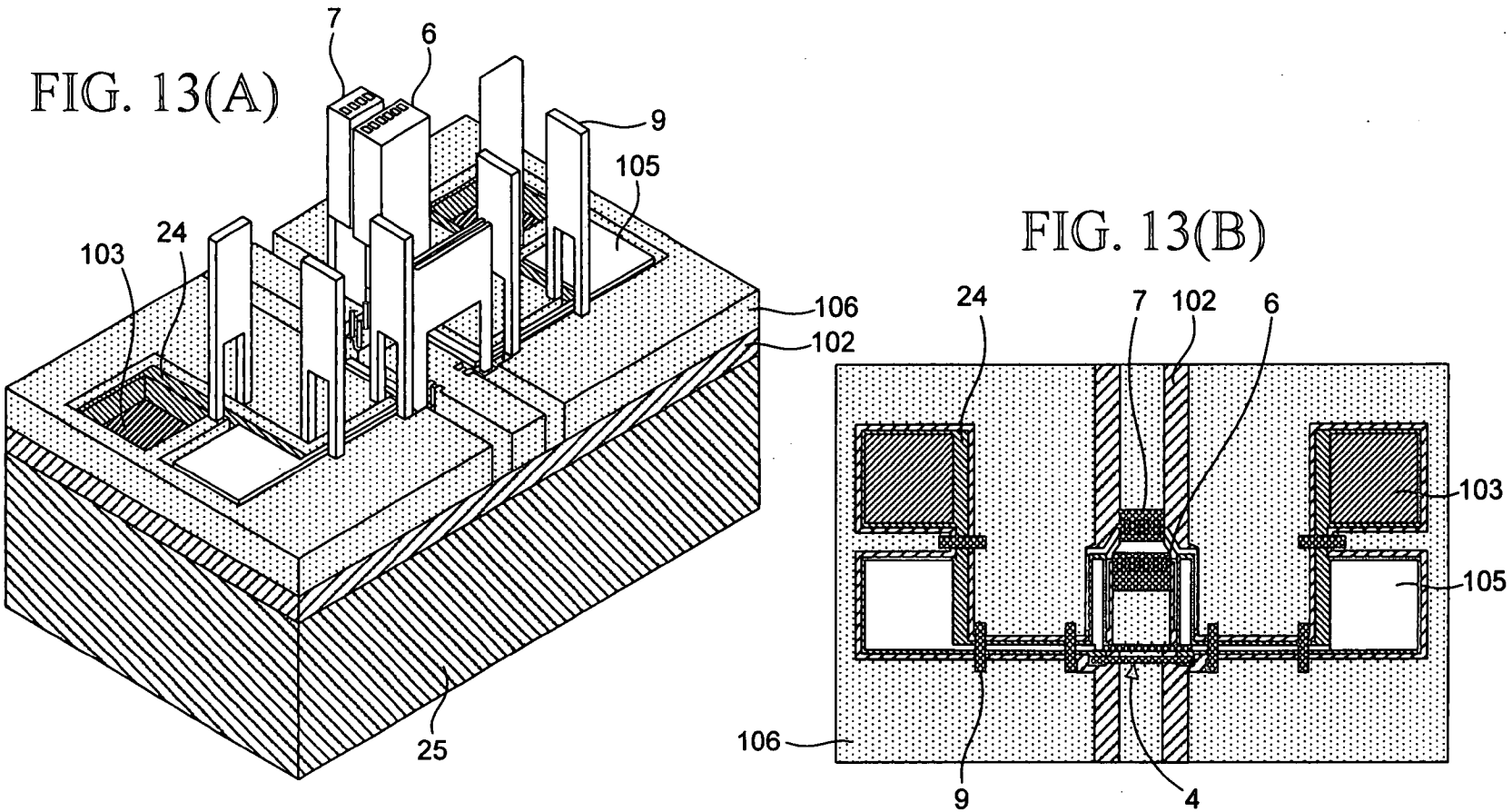
FIG. 13(A) is a schematic perspective view illustrating sacrificial layer removal during an intermediate processing step for fabricating the RF series switch of FIG. 1 according to an embodiment herein.
FIG. 13(B) is a schematic top view of FIG. 13(A) according to an embodiment herein.
Figure 14B:
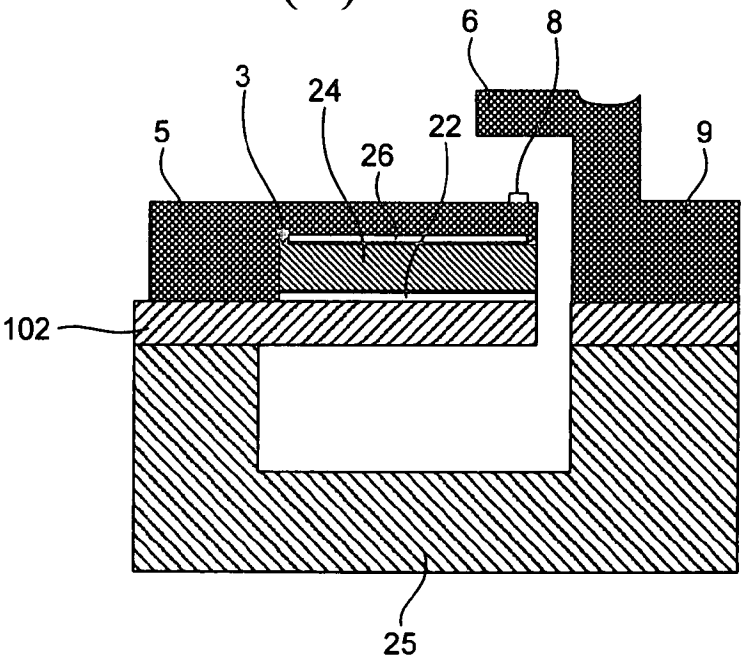
FIG. 14(B) is a cross-sectional diagram of FIG. 14(A) according to an embodiment herein.
Figure 14A:
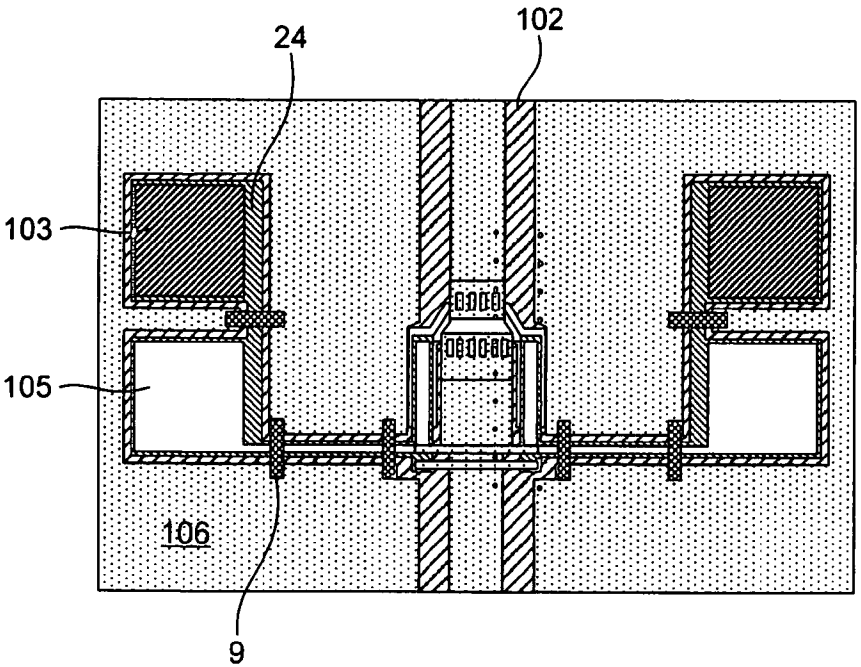
FIG. 14(A) is a schematic top view illustrating the $XeF_2$ silicon etch release of the actuators and RF contact pad during an intermediate processing step for fabricating the RF series switch of FIG. 1 according to an embodiment herein.

FIGS. 13(A) and 13(B) illustrate the formation process when the entire sacrificial layer 107 (of FIGS. 10(A) through 12(B)) is removed. Here, the RF cantilevers 6, 7, the top and bottom electrode bias line air bridges 4, and the ground straps 9 are released in an oxygen plasma resist removal process. Next, in FIGS. 14(A) and 14(B), the actuators 3 are structurally released by performing a $XeF_2$ isotropic etch of the underlying silicon substrate 25 to release the actuators 3 and RF contact pad 5 from the substrate 25. FIG. 14(B) is a cross-sectional view illustrating the region located between the dashed lines in FIG. 14(A). FIGS. 15(A) and 15(B) illustrate the completed RF MEMS switch 100.

Figure 16:
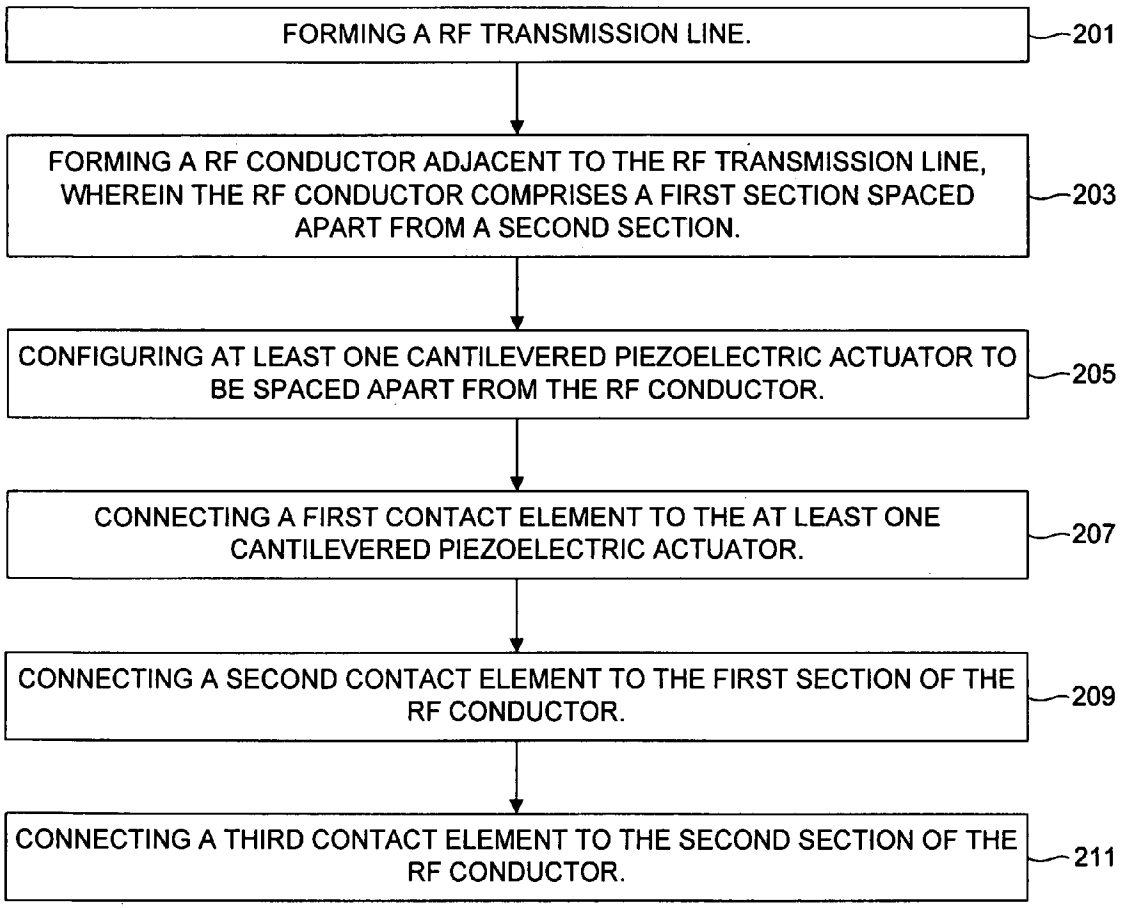
FIG. 16 is a flow diagram illustrating a preferred method according to an embodiment herein.

FIG. 16, with reference to FIGS. 1 through 15(B) is a flow diagram illustrating a method of fabricating a MEMS switch 100 according to an embodiment herein, wherein the method comprises forming (201) a RF transmission line 20 and forming (203) a RF conductor 1 adjacent to the RF transmission line 20, wherein the RF conductor 1 comprises a first section 51 spaced apart from a second section 52. The method further includes configuring (205) at least one cantilevered piezoelectric actuator 3 to be spaced apart from the RF conductor 1; connecting (207) a first contact element 5 to the at least one cantilevered piezoelectric actuator 3; connecting (209) a second contact element 6 to the first section 51 of the RF conductor 1; and connecting (211) a third contact element 7 to the second section 52 of the RF conductor 1. Preferably, the formation of the RF transmission line 20 comprises flanking a pair of co-planar waveguide ground planes 2 adjacent to the RF conductor 1 and connecting a plurality of ground straps 9 to the pair of co-planar waveguide ground planes 2, wherein the RF transmission line 20 is operable to provide a path along which RF signals propagate.

The configuration of each cantilevered piezoelectric actuator 3 preferably comprises providing an elastic layer 10; connecting a bottom electrode 22 to the elastic layer 10; connecting a piezoelectric layer 24 on the bottom electrode 22; connecting a top electrode 26 on the piezoelectric layer 24; and offsetting the top electrode 26 from an edge 27 of the piezoelectric layer 24 and the bottom electrode 22.

The method further comprises connecting a plurality of air bridges 4 to the at least one cantilevered piezoelectric actuator 3 and forming a plurality of contact dimples 8 on the first contact element 5. During operation, voltage applied to the at least one cantilevered piezoelectric actuator 3 causes vertical deflection of the at least one cantilevered piezoelectric actuator 3 thereby causing the first contact element 5 to contact each of the second and third contact elements 6, 7 thereby providing a continuous path for allowing a RF signal to propagate through the RF conductor 1.

The method further comprises connecting a first one 62 of the plurality of air bridges 4 to the top electrode 26 and connecting a second one 64 of the plurality of air bridges 4 to the piezoelectric layer 24. Furthermore, the method comprises positioning the contact dimples 8 beneath a free end of each of the second and third contact elements 6, 7. Additionally, the method comprises forming the RF conductor 1 to be mechanically stationary.

The miniaturization of an RF MEMS switch 100 may be used in cellular phone and wireless products. Moreover, military communication and radar systems also benefit from the further miniaturization of RF circuits by incorporating the RF MEMS switch 100 in various designs. Additionally, the high performance RF MEMS switch 100 provided by the embodiments herein can enable low loss and low cost RF phase shifters for electronic scanning antenna (ESA) applications, reconfigurable antenna, RF seekers, ground-based radars, and millimeter wave (MMW) sensors components.

Furthermore, the embodiments herein increase manufacturability of RF switches compared to conventional switches. Decoupling (i.e., structurally isolating) the actuators 3 from the RF conductor 1 increases the actuator efficiency of the switch 100 allowing either lower voltage operation (<5 V) or smaller, faster switch designs yielding more dense circuit designs. Furthermore, the embodiments herein provide for a potentially greater increased device lifetime by mitigating and potentially eliminating the primary failure mechanism associated with traditional (capacitive) electrostatic shunt switches. Moreover, relatively extremely large contact gaps 11 are attainable thereby allowing for very large RF isolation. Additionally, large restoration (opening) forces are attainable using the embodiments herein.

The techniques provided by the embodiments herein may be implemented on an integrated circuit (IC) chip or using printable electronic technologies (not shown). The chip or printable electronic circuit design is created in a graphical computer programming language, and stored in a computer storage medium (such as a disk, tape, physical hard drive, or virtual hard drive such as in a storage access network). If the designer does not fabricate chips or printable electronic circuits or the photolithographic masks used to fabricate chips or printable electronic circuits, the designer transmits the resulting design by physical means (e.g., by providing a copy of the storage medium storing the design) or electronically (e.g., through the Internet) to such entities, directly or indirectly. The stored design is then converted into the appropriate format (e.g., GDSII or CIF) for the fabrication of photolithographic masks, which typically include multiple copies of the chip design in question that are to be formed on a wafer or printed on a suitable substrate. The photolithographic masks are utilized to define areas of the wafer or printable electronic circuits (and/or the layers thereon) to be etched or otherwise processed or printed.

The resulting integrated circuit chips or printable electronic circuits can be distributed by the fabricator in raw wafer form (that is, as a single wafer that has multiple unpackaged chips), as a bare die, or in a packaged form or as individual printed circuits or in a sheet or roll of printed circuits. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip might then be integrated with other chips, discrete circuit elements, and/or other signal processing devices as part of either (a) an intermediate product, such as a mother or daughter-board, or (b) an end product. The end product can be any product that includes an integrated circuit chip or chips and/or printed circuits, ranging from toys and other low-end applications to advanced computer products having a display, a keyboard or other input device, and a central processor.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A microelectromechanical system (MEMS) switch comprising:

a radio frequency (RF) transmission line;

a structurally discontinuous RF conductor adjacent to said RF transmission line;

a pair of cantilevered piezoelectric actuators flanking said RF conductor;

a contact pad connected to said pair of cantilevered piezoelectric actuators;

a pair of cantilevered structures connected to said RF conductor;

a plurality of air bridges connected to said pair of cantilevered piezoelectric actuators; and a plurality of contact dimples on said contact pad.

2. The MEMS switch of claim 1, wherein said RF transmission line comprises:

a pair of co-planar waveguide ground planes flanking said RF conductor; and a plurality of ground straps connected to said pair of co-planar waveguide ground planes, wherein said RF transmission line is operable to provide a path along which RF signals propagate.

3. The MEMS switch of claim 1, wherein each cantilevered piezoelectric actuator comprises:

an elastic layer;

a bottom electrode connected to said elastic layer;

a top electrode; and a piezoelectric layer in between the top and bottom electrodes, wherein said top electrode is offset from an edge of said piezoelectric layer and said bottom electrode.

4. The MEMS switch of claim 1, wherein said pair of cantilevered piezoelectric actuators are structurally isolated from said RF conductor.

5. The MEMS switch of claim 1, wherein voltage applied to said pair of cantilevered piezoelectric actuators causes vertical deflection of said pair of cantilevered piezoelectric actuators thereby causing said contact pad to contact said pair of cantilevered structures thereby providing a continuous path for allowing a RF signal to propagate through said RF conductor.

6. The MEMS switch of claim 3, wherein a first one of said plurality of air bridges connects to said top electrode and a second one of said plurality of air bridges connects to said piezoelectric layer.

7. The MEMS switch of claim 1, wherein said contact dimples are positioned beneath a free end of each of said pair of cantilevered structures.

8. The MEMS switch of claim 1, wherein said RF conductor is mechanically stationary.

9. A microelectromechanical system (MEMS) switch comprising:

a radio frequency (RF) transmission line;

a RF conductor adjacent to said RF transmission line, wherein said RF conductor comprises a first section spaced apart from a second section;

at least one cantilevered piezoelectric actuator spaced apart from said RF conductor;

a first contact element connected to said at least one cantilevered piezoelectric actuator;

a second contact element connected to said first section of said RF conductor; and a third contact element connected to said second section of said RF conductor.

10. The MEMS switch of claim 9, wherein said RF transmission line comprises:

a pair of co-planar waveguide ground planes flanking said RF conductor; and a plurality of ground straps connected to said pair of co-planar waveguide ground planes, wherein said RF transmission line is operable to provide a path along which RF signals propagate.

11. The MEMS switch of claim 9, wherein each cantilevered piezoelectric actuator comprises:

an elastic layer;

a bottom electrode connected to said elastic layer;

a top electrode; and a piezoelectric layer in between the top and bottom electrodes, wherein said top electrode is offset from an edge of said piezoelectric layer and said bottom electrode.

12. The MEMS switch of claim 11, further comprising:

a plurality of air bridges connected to said at least one cantilevered piezoelectric actuator; and a plurality of contact dimples on said first contact element.

13. The MEMS switch of claim 9, wherein voltage applied to said at least one cantilevered piezoelectric actuator causes vertical deflection of said at least one cantilevered piezoelectric actuator thereby causing said first contact element to contact each of the second and third contact elements thereby providing a continuous path for allowing a RF signal to propagate through said RF conductor.

14. The MEMS switch of claim 12, wherein a first one of said plurality of air bridges connects to said top electrode and a second one of said plurality of air bridges connects to said piezoelectric layer.

15. The MEMS switch of claim 12, wherein said contact dimples are positioned beneath a free end of each of the second and third contact elements.

16. The MEMS switch of claim 9, wherein said RF conductor is mechanically stationary.

17. A method of fabricating a microelectromechanical system (MEMS) switch, said method comprising:

forming a radio frequency (RF) transmission line;

forming a RF conductor adjacent to said RF transmission line, wherein said RF conductor comprises a first section spaced apart from a second section;

configuring at least one cantilevered piezoelectric actuator to be spaced apart from said RF conductor;

connecting a first contact element to said at least one cantilevered piezoelectric actuator;

connecting a second contact element to said first section of said RF conductor; and connecting a third contact element to said second section of said RF conductor.

18. The method of claim 17, wherein the formation of said RF transmission line comprises:

flanking a pair of co-planar waveguide ground planes adjacent to said RF conductor; and connecting a plurality of ground straps to said pair of co-planar waveguide ground planes, wherein said RF transmission line is operable to provide a path along which RF signals propagate.

19. The method of claim 17, wherein the configuration of each cantilevered piezoelectric actuator comprises:

providing an elastic layer;

connecting a bottom electrode to said elastic layer;

connecting a piezoelectric layer on said bottom electrode;

connecting a top electrode on said piezoelectric layer; and offsetting said top electrode from an edge of said piezoelectric layer and said bottom electrode.

20. The method of claim 18, further comprising:

connecting a plurality of air bridges to said at least one cantilevered piezoelectric actuator; and forming a plurality of contact dimples on said first contact element.

21. The method of claim 17, wherein voltage applied to said at least one cantilevered piezoelectric actuator causes vertical deflection of said at least one cantilevered piezoelectric actuator thereby causing said first contact element to contact each of the second and third contact elements thereby providing a continuous path for allowing a RF signal to propagate through said RF conductor.

22. The method of claim 20, further comprising:

connecting a first one of said plurality of air bridges to said top electrode; and connecting a second one of said plurality of air bridges to said piezoelectric layer.

23. The method of claim 20, further comprising positioning said contact dimples beneath a free end of each of the second and third contact elements.

24. The method of claim 17, further comprising forming said RF conductor to be mechanically stationary.

* * * * *